US006187172B1

(12) United States Patent
Plummer

(10) Patent No.: US 6,187,172 B1
(45) Date of Patent: Feb. 13, 2001

(54) VISCOSITY REDUCTION OF CRUDE OILS AND RESIDUUMS

(75) Inventor: Mark A. Plummer, Littleton, CO (US)

(73) Assignee: Marathon Oil Company, Houston, TX (US)

( * ) Notice: Under 35 U.S.C. 154(b), the term of this patent shall be extended for 0 days.

(21) Appl. No.: 09/317,551

(22) Filed: May 24, 1999

(51) Int. Cl.[7] ..... C10C 1/20
(52) U.S. Cl. ..... 208/44; 208/22; 208/39
(58) Field of Search ..... 208/22, 39, 44, 208/309

(56) References Cited

U.S. PATENT DOCUMENTS 4,752,587 6/1988 Dickakian ..... 436/60
5,100,531 3/1992 Stephenson et al. ..... 208/22
5,132,005 7/1992 Derosa et al. ..... 208/44
5,133,781 * 7/1992 Derosa et al. ..... 208/44

* cited by examiner

*Primary Examiner*—Helane E. Myers
(74) *Attorney, Agent, or Firm*—Jack E. Ebel

(57) ABSTRACT

Adverse effects of asphaltenes in liquid hydrocarbons are reduced by incorporating into the liquid hydrocarbon sufficient concentration, e.g., about 0.5 to 5 weight % of a dispersant to disassemble or break up agglomerates of the asphaltenes. The dispersant has a polarity of about 0.3 to about 3.2 Debye Units and is preferably selected from the group of toluene, o-xylene, m-xylene, tetralin, furan, phenol, ethyl benzoate, butraldehyde, acetophenone and cyclohexanone.

11 Claims, 4 Drawing Sheets

LOG(LOG(VISCOSITY)) VS. KEROSENE AND DISPERSANT BLENDED WITH PITCH

INTERCEPT OF LOG(LOG(VISCOSITY)) FOR A PITCH VERSUS ASPHALTENE DISPERSANT POLARITY

INTERCEPT OF LOG (LOG(VISCOSITY)) FOR VENEZUELAN CRUDE OIL VERSUS ASPHALTENE DISPERSANT POLARITY

LOG(LOG(VISCOSITY)) VERSUS KEROSENE AND ASPHALTENE DISPERSANT CONTENTS IN NO. 6 FUEL OIL BLEND

VISCOSITY REDUCTION OF CRUDE OILS AND RESIDUUMS

BACKGROUND OF THE INVENTION

1. Field of the Invention

The present invention relates to a method of reducing the adverse effects of asphaltenes in liquid hydrocarbons and thereby increasing the fluidity of the liquid hydrocarbon. A dispersing agent is added to the liquid hydrocarbon to break up or disassemble agglomerates of asphaltenes and other hydrocarbons containing heteroatoms, e.g. sulfur containing compounds, to reduce the viscosity of the hydrocarbon.

2. Description of Related Art

A need exists to improve the pumpability or fluidity of crude oils and residuums containing asphaltenes so that they can be more easily transported in pipelines, etc. and processed in refineries. Viscous crude oils or "heavy" crude oils are becoming more common in the oil industry and due to their viscous properties they are more costly to handle as compared to the "sweeter" crude oils.

Asphaltenes, due to the polarity of their aromatic rings, agglomerate into very large structures in liquid hydrocarbons. These agglomerates yield viscosities that are much higher than if the asphaltenes were not structured. The usual approach in reducing the viscosity of high asphaltene containing hydrocarbons is to add kerosene or other non-polar distillates. Kerosenes or distillates do not disperse asphaltene agglomerates; they merely dilute the agglomerates to obtain a lower viscosity of lesser extent than if the agglomerates were truly dispersed into individual molecules. Adding kerosene or distillate in sufficient quantities to obtain the desired viscosity can be very costly, especially if the concentrations of the asphaltenes are high.

Addition of kerosene or distillate in some cases can result in more agglomeration and can even cause precipitation of asphaltenes in crude oils. That is, the asphaltenes may, under some circumstances, precipitate to form a sludge which plugs up oil bearing formations and prevents the recovery of additional crude oil from the formations. Also, the sludge can form on valves, on pump impellers, in conduits, etc. and cause adverse mechanical conditions.

It is generally advantageous to keep the asphaltenes in a stable suspension in the hydrocarbon liquid until well into the refining process. This not only increases the ultimate yield but also prevents or reduces the maintenance problems in the process and improves productivity from hydrocarbon formations. Examples of how the prior art has addressed this problem include the following:

U.S. Pat. No. 5,100,531 discloses a method of dispersing asphalt and asphaltenes in crude oil by adding an effective amount of an antifoulant which consists of a mixture of 1) 95–5 weight % of an alkyl substituted phenol-formaldehyde liquid resin having a molecular weight of 1,000 to 20,000 and an alkyl substituent containing 4 to 24 carbon atoms, the alkyl substituent can be a linear or a branched alkyl group, and 2) 5–95 weight percent of a hydrophilic-lipophilic vinylic polymer.

U.S. Pat. No. 5,133,781 discloses a method of stabilizing asphaltenes in hydrocarbons by dissolving the asphaltenes in tetrahydrofuran and then phosphochlorinating the asphaltenes and thereafter reacting the phosphochlorinated-asphaltenes with equimolar amounts of aliphatic or aromatic alcohols.

U.S. Pat. No. 5,494,607 teaches the use of alkyl substituted phenol-formaldehyde resin and various hydrophilic-lipophilic vinyl polymers as asphaltene dispersants. Such combinations enhance the refining of heavy crude oils containing asphaltenes.

U.S. Pat. No. 5,156,975 teaches the use of 40% polyisobutenylsuccinate in as aromatic solvent as asphaltene dispersant antifouling agent. The dispersant can be present in concentrations of about 10 to about 500 ppm.

U.S. Pat. No. 4,752,587 teaches a method of determining the fouling tendency of an asphaltene containing crude oil by the use of thin layer chromatography. The crude oil sample is prepared in the presence of an asphaltene antisolvent; the antisolvent is preferably a combination of a low molecular weight paraffinic hydrocarbon and a hydrocarbon containing polar atoms such as oxygen, nitrogen, chlorine and sulfur.

U.S. Pat. No. 5,132,005 teaches a method of compatibilizing asphaltenes containing bituminous liquids by dissolving the asphaltenes in a solvent, e.g. tetrahydrofuran, and then phosphochlorinating the asphaltene with phosphorous trichloride following by bulk amination of the phosphochlorinated-asphaltene intermediate. This process stabilizes the asphaltene in the bituminous liquid well into the refining process.

It is an object of this invention to improve the dispersion of asphaltene agglomerates in hydrocarbons to lower the viscosity of the hydrocarbon.

It is a further object of the present invention to provide an improved method of lowering the costs for reducing the viscosity of a crude oil or residuum containing asphaltenes by incorporating an asphaltene dispersant to replace a portion of a non-polar diluent, such as kerosene or distillate, that was added to reduce the viscosity.

SUMMARY OF THE INVENTION

To achieve the foregoing and other objectives, and in accordance with the objectives of the present invention, as embodied and broadly described herein, an effective amount of an asphaltene dispersant having a herein defined polarity is added to the asphaltene containing hydrocarbon to substantially reduce the adverse effects of the asphaltene in the hydrocarbon. The dispersant acts to disassemble asphaltene agglomerates.

The asphaltene containing liquid hydrocarbon can be crude oil, tar sand oil, residuums, refinery streams, shale oil and any liquid hydrocarbon containing asphaltenes. Asphaltenes are generally soluble in carbon disulfide but insoluble in paraffin naphthas. The asphaltene agglomerates can be described as containing layers of stacked sheets of condensed rings having a molecular weight of about 500 to about 5,000. Concentrations of the asphaltene in the hydrocarbon can range up to 50% in tar sands and up to 100% in some resids; however, a typical crude oil generally has an asphaltene concentration of about 0.1 to about 30 weight %. When the asphaltenes become agglomerated, they cause large increases in the viscosities of the hydrocarbons. This invention discloses a cost-effective method of disassembling the agglomerated asphaltenes in liquid hydrocarbons.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
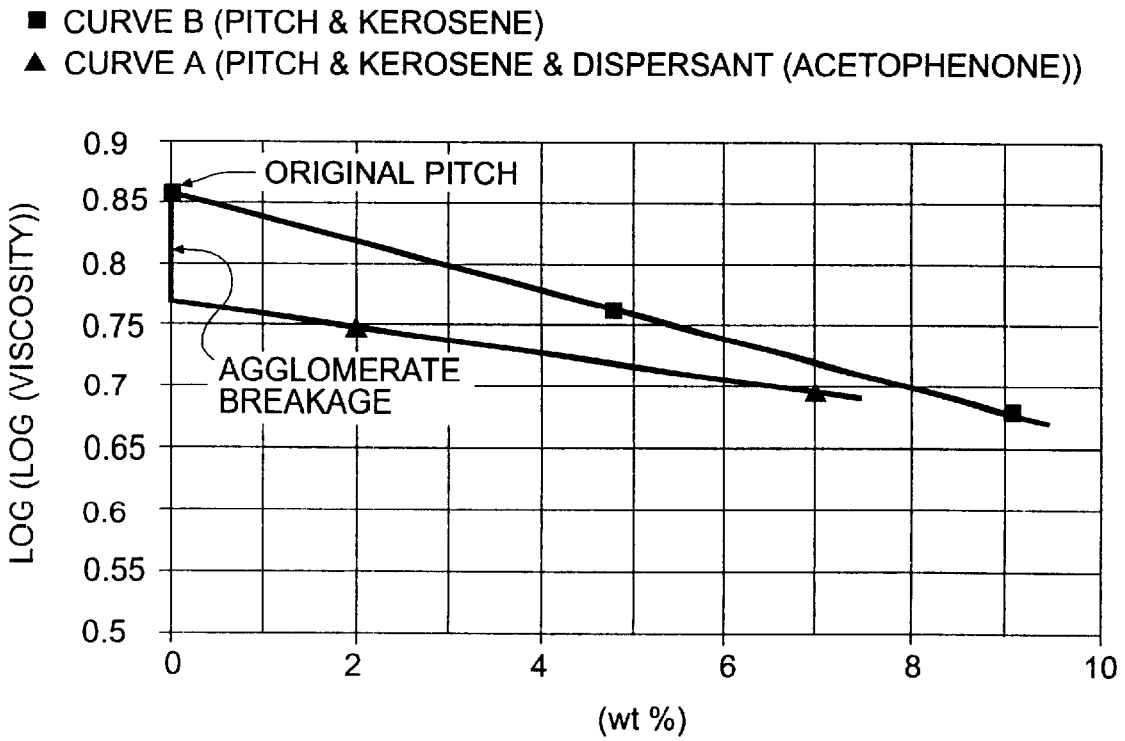
FIG. 1 shows the effect of dispersant and kerosene in No. 6 Fuel Oil blended from a pitch.

Referring to FIG. 1, a pitch (containing 29.5 weight % asphaltenes) processed from an Arabian/Mexican crude oil via conventional distillation and ROSE processing is studied. Kerosene is added to the pitch to make a No. 6 fuel oil. The log (log (viscosity)), hereinafter referred to as the "LLC," of the resulting No. 6 fuel oil combinations are plotted versus weight % kerosene as curve "B." In a separate study, acetophenone is added as a dispersant to the pitch and the LLC is plotted as curve "A." The steep portion of curve A near zero weight % of acetophenone represents the breaking up of agglomerated asphaltenes in the Fuel Oil. Curve A is extrapolated to zero acetophenone content to obtain an "effective" LLV for the pitch with reduced asphaltene agglomeration via the use of acetophenone. The "effective" LLV of a particular dispersant is an indication of reduced agglomeration of the asphaltenes in the hydrocarbon.

Figure 2:
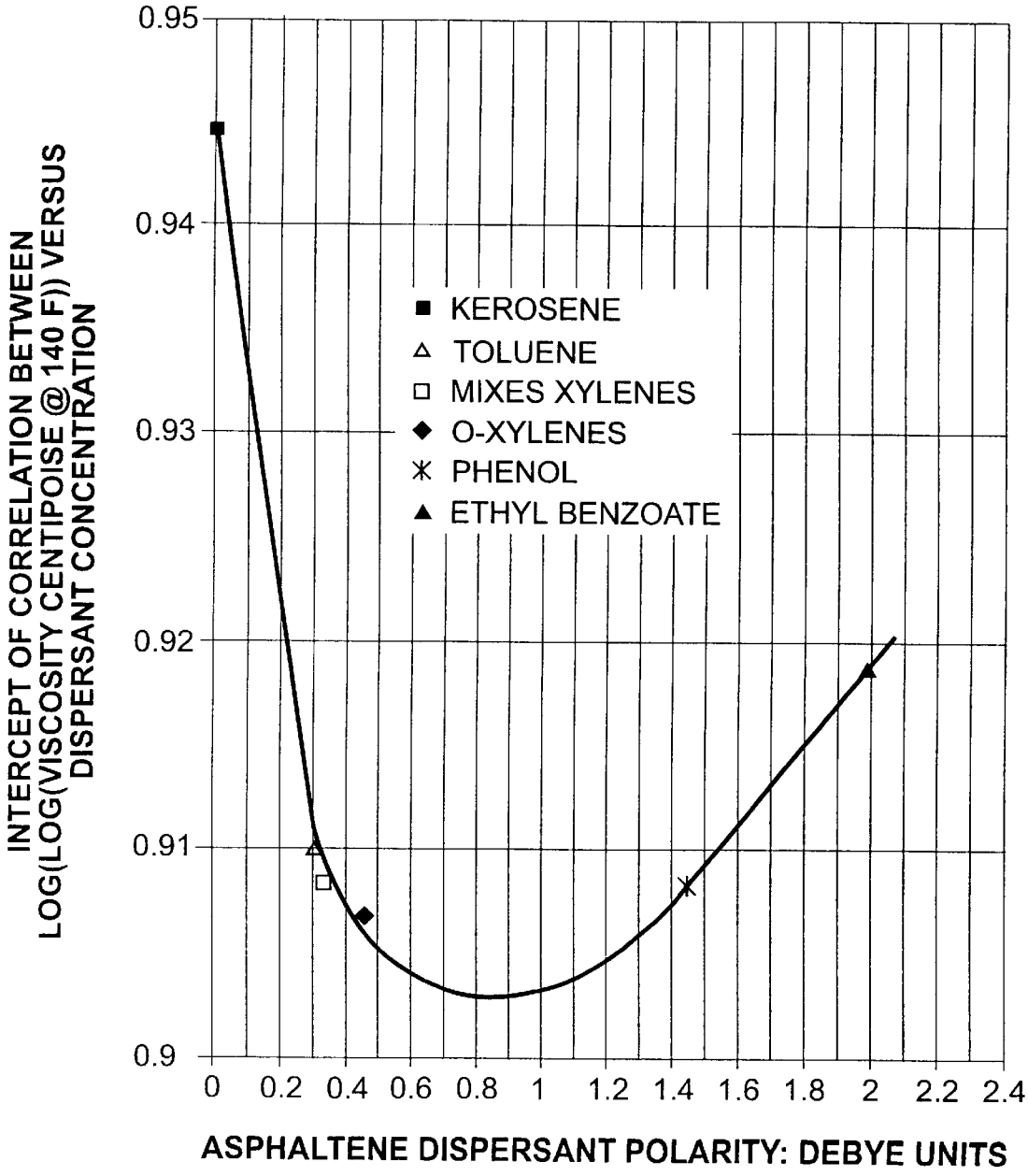
FIG. 2 shows the intercept of a log (log (viscosity)) plot for a pitch obtained from an Arabian/Mexican crude oil, contains 29.5 weight % asphaltenes, versus asphaltene dispersant polarity.

Referring to FIG. 2, this figure shows the "effective" LLC for different dispersants with the pitch defined in FIG. 1. It shows a preferred range of the dispersants polarity of about 0.3 to about 1.6 Debye Units for this hydrocarbon—see Example 1.

Figure 3:
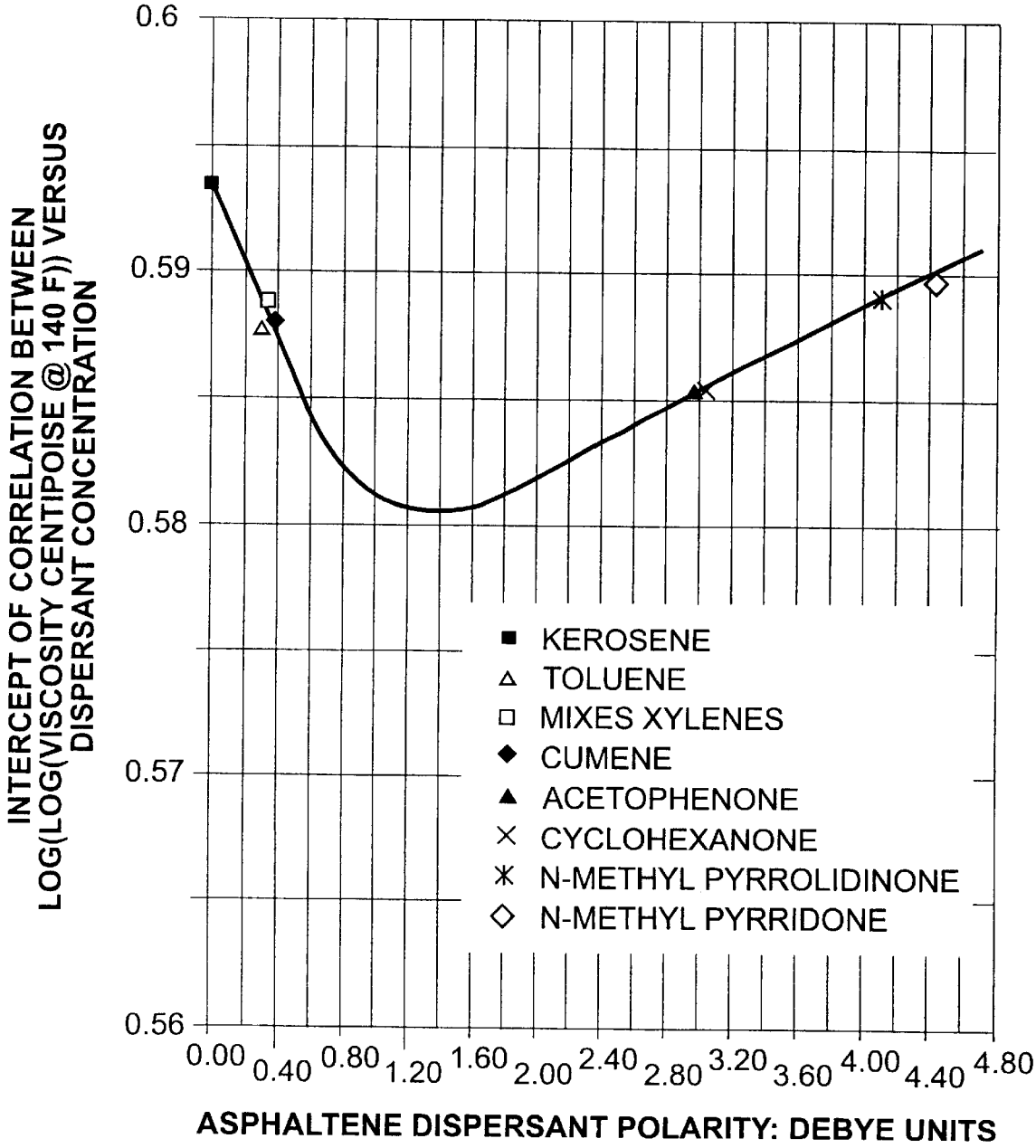
FIG. 3 shows the intercept of a log (log (viscosity)) plot for a Venezuelan crude oil versus asphaltene dispersant polarity.

Referring to FIG. 3, this curve shows the "effective" LLC for different dispersants with a Venezuelan crude oil (contains about 18 weight % asphaltenes). The preferred polarity of the dispersant for this crude oil is within the range of about 0.5 to about 3.0 Debye Units—see Example 2.

Figure 4:
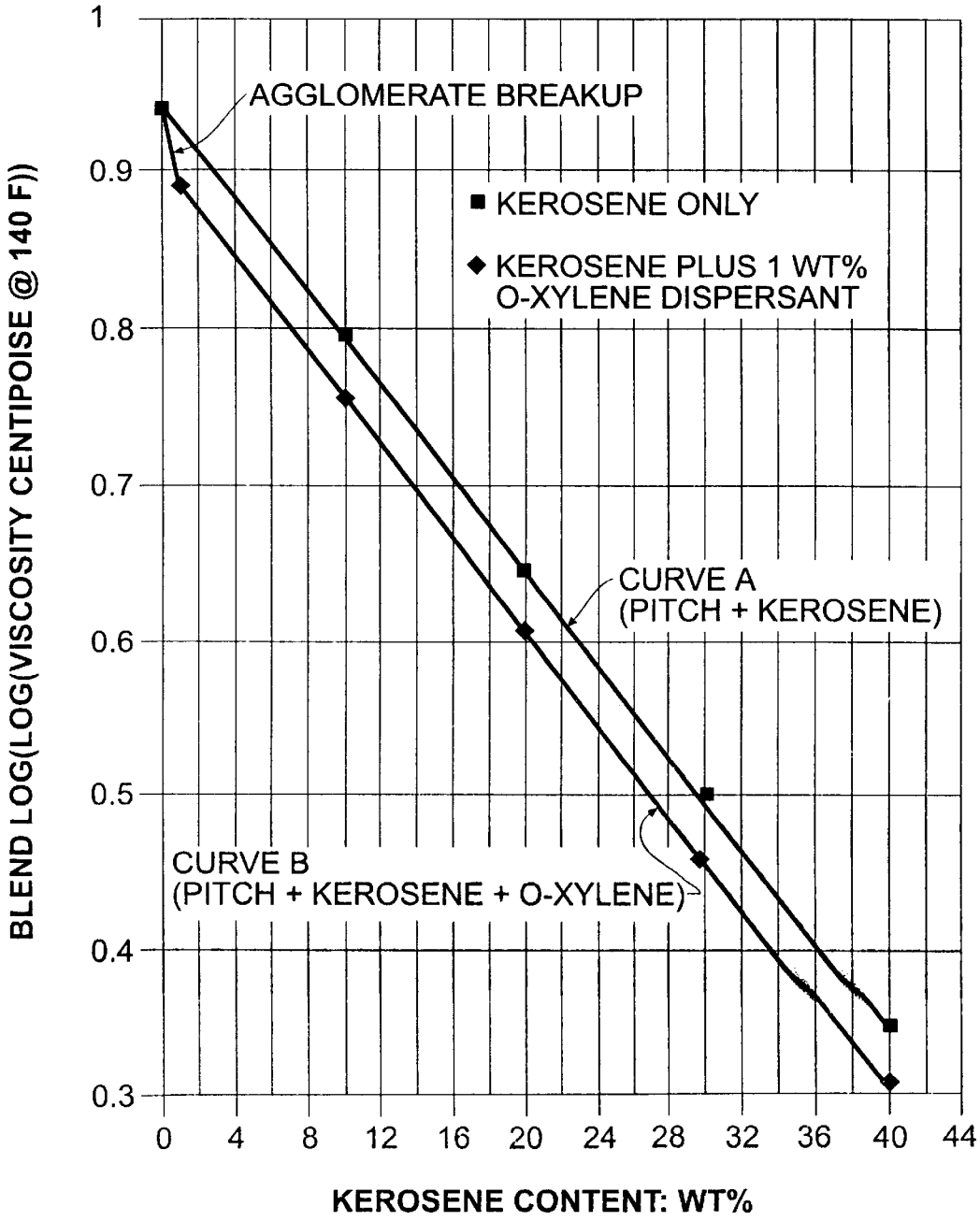
FIG. 4 shows the effect of adding o-xylene as a dispersant to compliment the use of kerosene as a diluent in No. 6 fuel oil blended from a pitch which contains about 29.5 weight % asphaltenes.

FIG. 4 shows the LLC for a No. 6 fuel oil made by blending a pitch (contains about 29.5 weight % asphaltenes) and kerosene (curve A) and the same pitch blended with kerosene and 1 weight % o-xylene (curve B). Between 0 and 1 weight % o-xylene, the curves show break-up of the agglomerated asphaltenes.

The hydrocarbon containing asphaltenes can be crude oil, shale oil, tar sand oil, pitch (viscous substance obtained as a residue from the distillation or solvent extraction of crude oil, coal tar, etc.), resids (topped crude oil or viscous residuum obtained in a refinery operation), No. 6 fuel oil, and like hydrocarbons. Typically, the hydrocarbon contains about 0.1 to about 50 and preferably about 1 to about 30 weight % asphaltenes. However, the hydrocarbon, e.g., resids, can contain up to 100% asphaltenes. Such hydrocarbons can have viscosities of about 1000 to about $1@10^9$ centipoise at 140° F. and, after treatment via this invention, the viscosities can be reduced to about 1 to about 800 centipoise at 140° F. The amount of dispersant added to the hydrocarbon and, optionally the amount of diluent or cutter, e.g., kerosene or like hydrocarbon or distillate, is dependent on the desired viscosity of the liquid hydrocarbon.

A diluent or cutter, such as kerosene or like distillate, can be added to the hydrocarbon containing asphaltenes, concentrations within the range of 0.5 to 50 weight % and more preferably about 1.0 to 25 weight % are useful. The dispersants of this invention are useful with the diluents as the examples illustrate.

The dispersants of this invention are soluble in the liquid hydrocarbon and have a polarity of about 0.3 to about 3.2 and preferably about 0.4 to about 2.0 and most preferably about 0.8 to about 1.6 Debye Units. Polarity or dipole moment is a measure of the displacement of the centers of gravity of positive and negative charges of a molecule. It is the product of a charge and a distance. The units of polarity are expressed in either electrostatic units (esu) or Deybe Units (DU). One Debye Unit equals $10^{-18}$ esu.

The dispersant can contain heteroatoms such as oxygen, nitrogen or sulfur. However, nitrogen and sulfur heteroatoms can cause environmental problems during processing in a refinery. Dispersants containing nitrogen and sulfur heteroatoms may be removed from the hydrocarbon during or after transportation and before refining.

Preferred dispersants include aromatics hydrocarbons and aromatic hydrocarbons substituted with alkyl groups such as toluene (0.31 DU), o-xylene (0.45 DU), m-xylene (0.30 DU), and tetralin (0.60 DU). Preferred oxygen containing dispersants include furan (0.60 DU), phenol (1.45 DU), ethyl benzoate (1.99 DU), butraldehyde (2.45 DU), acetophenone (2.96 DU), and cyclohexanone (3.01 DU).

The amount of dispersant added to the hydrocarbon will depend on the desired viscosity of the hydrocarbon, the concentration of asphaltenes in the hydrocarbon, the type of hydrocarbon, etc. Amounts in the range of about 0.1 to about 10.0 weight % and preferably about 0.5 to about 5.0 weight % and more preferably about 1.0 to about 4.0 weight % of dispersant in the hydrocarbon are generally required to obtain desired viscosities of the liquid hydrocarbon. However, with a hydrocarbon containing a large concentration of asphaltenes, the concentration of the dispersant can be up to 25 weight %. The dispersant can be added to the hydrocarbon using conventional methods.

The desired viscosity of the treated liquid hydrocarbon will depend on the ultimate use of the hydrocarbon; however, it should generally have a viscosity within the range of about 1 to about 1000 and preferably about 100 to about 800 centipoise (cP) at 100 to 140° F. for most transportation and refinery purposes.

The following examples demonstrate the practice and utility of the present invention, but they are not meant to be construed as limiting the scope thereof.

EXAMPLE 1

A pitch, having a viscosity of 562 $10^6$ centipoise at 140° F., obtained from conventional atmospheric and vacuum distillations followed by ROSE processing of a Arabian/Mexican crude oil, is blended into separate samples containing 1, 2, 3 and 4 weight % of the dispersants defined in FIG. 2. Mixing of the components is performed in high-pressure tubes. The tubes are purged with nitrogen to prevent oxidation during mixing of the components at 400° F. for two hours. The mixtures are constantly shaken during the two-hour heating. The mixtures are then cooled to 140° F. and viscosities measured. Thereafter, the LLV (log log centipoise viscosity @ 140° F.) of the mixtures versus dispersant content in weight % is plotted. The plot is extrapolated back to 0 weight % dispersant to obtain an "effective" LLV for each pitch/dispersant combination. If the "effective" LLV of a pitch/dispersant is less than that for the pitch without a dispersant, the dispersant is capable of breaking up asphaltene agglomerates. Kerosene is essentially non-polar and does not break up the agglomerates whereas all the polar dispersants defined in FIG. 2 yield effective LLV values below that obtained with kerosene or no dispersant. The "effective" LLV results obtained are plotted versus dispersant polarity in FIG. 2 and show a critical polarity range of about 0.3 to about 1.6 DU. For a dispersant polarity of about 0.8 DU, the effective LLV is expected to be about 0.903 for the pitch which is significantly lower than the LLV of 0.945 for the same pitch absent any dispersant. Hence, significant asphaltene agglomeration reduction in the pitch is obtained using dispersants in the above critical polarity range.

EXAMPLE 2

The procedure of Example 1 is repeated except the asphaltene containing hydrocarbon is a Venezuelan crude oil having a viscosity of about 8300 cP at 140° F., the dispersants defined in FIG. 3 are studied. The "effective" LLV results are plotted in FIG. 3 and show a critical polarity range of about 0.5 to about 3.2 DU for the dispersants with this crude oil. Based on these results, a minimum "effective" LLV of about 0.581 is expected for a dispersant polarity of about 1.40 DU. This minimum "effective" LLV is significantly less than the LLV of 0.593 for the crude oil without a dispersant showing a significant reduction in the level of asphaltene agglomeration.

While the foregoing preferred embodiments of the invention have been described and shown, it is understood that the alternatives and modifications, such as those suggested and others, may be made thereto and fall within the scope of the invention.

What is claimed is:

1. A method for dispersing asphaltenes in a liquid hydrocarbon consisting essentially of introducing from about 0.1 to about 25 weight percent of a hydrocarbon soluble asphaltene dispersant into the liquid hydrocarbon, said dispersant having a polarity of about 0.3 to about 3.2 Debye Units.

2. The method of claim 1 wherein the dispersant is selected from the group consisting of toluene, o-xylene, m-xylene, and tetralin and furan, phenol, ethyl benzoate, butraldehyde, acetophenone, and cyclohexanone.

3. The method of claim 1 wherein the polarity of the dispersant is between 0.4 and about 2.0 Debye Units.

4. The method of claim 1 wherein the polarity of the dispersant is between about 0.8 and about 1.6 Debye Units.

5. The method of claim 1 wherein about 0.1 to about 10 weight % of the dispersant is added to the liquid hydrocarbon.

6. The method of claim 1 wherein about 0.5 to about 5.0 weight percent of the dispersant is added to the liquid hydrocarbon.

7. The method of claim 1 wherein a hydrocarbon distillate is added to the liquid hydrocarbon.

8. The method of claim 1 wherein the liquid hydrocarbon contains kerosene.

9. The method of claim 1 wherein about 0.5 to about 50.0 weight % of kerosene is added to the liquid hydrocarbon.

10. A method for dispersing asphaltenes in a liquid hydrocarbon containing kerosene as a diluent consisting essentially of incorporating in the liquid hydrocarbon from about 0.1 to about 10 weight % of an asphaltene dispersant soluble in the liquid hydrocarbon and having a polarity of about 0.3 to about 3.2 Debye Units.

11. The method of claim 10 wherein the dispersant is selected from the group consisting of toluene, o-xylene, m-xylene, tetralin, furan, phenol, ethyl, benzoate, butraldehyde, acetophenone and cyclohexanone.

* * * * *